US005247788A

United States Patent [19]

Bertrams et al.

[11] Patent Number: 5,247,788

[45] Date of Patent: Sep. 28, 1993

[54] FLEXIBLE TRANSPORT SYSTEM FOR GROUPWISE TRANSPORT OF TEXTILE YARN PACKAGES INCLUDING A MOBILE SUPPORT UNIT FOR SHUTTLING TEXTILE YARN PACKAGES BETWEEN TWO TEXTILE MACHINES

[75] Inventors: Josef Bertrams, Weberg; Karl-Heinz Mack, Weilheim; Manfred Langen; Gregor Gebald, both of Mönchengladbach, all of Fed. Rep. of Germany

[73] Assignee: W. Schlafhorst AG & Co., Moenchengladbach, Fed. Rep. of Germany

[21] Appl. No.: 768,162

[22] Filed: Sep. 30, 1991

[30] Foreign Application Priority Data

Sep. 29, 1990 [DE] Fed. Rep. of Germany ..... 4030861

[51] Int. Cl.[5] ..... B65H 54/02; B65H 67/04; B65G 1/00

[52] U.S. Cl. ..... 57/281; 57/90; 198/465.1; 414/331; 414/398

[58] Field of Search ..... 198/465.1; 414/331, 414/398, 400; 57/90, 281

[56] References Cited

U.S. PATENT DOCUMENTS

| | | | |
|---|---|---|---|
| 3,924,762 | 12/1975 | Igel | 414/331 |
| 4,144,961 | 3/1979 | Kasahara et al. | 57/281 X |
| 4,277,216 | 7/1981 | Lindberg | 414/400 X |
| 4,465,417 | 8/1984 | Baumann et al. | 198/347.4 X |
| 4,787,803 | 11/1988 | van Elten et al. | 414/398 X |
| 4,810,155 | 3/1989 | D'Agnolo | 414/331 |
| 5,078,565 | 1/1992 | Fritschi et al. | 242/35.5 A X |
| 5,195,687 | 3/1993 | Derichs et al. | 242/35.5 R |

FOREIGN PATENT DOCUMENTS

| | | | |
|---|---|---|---|
| 0344507A1 | 12/1989 | European Pat. Off. . | |
| 0114907 | 6/1986 | Japan | 198/347.4 |
| 531951 | 12/1972 | Switzerland . | |

*Primary Examiner*—Daniel P. Stodola
*Assistant Examiner*—William Stryjewski
*Attorney, Agent, or Firm*—Shefte, Pinckney & Sawyer

[57] ABSTRACT

A transport system for transporting tube support members between textile machines includes a mobile transport unit having a plurality of superposed floorings each of which supports and guides several rows of the tube support members. An onsite transfer assembly adjacent each textile machine is operable to simultaneously load tube support members onto the parallel support paths of the mobile support unit while unloading tube support members from the parallel paths onto the textile machine. Each flooring of the mobile support unit includes a transverse support surfaces at each end of the parallel support paths onto which a newly loaded row of tube support members can be positioned for subsequent movement into the parallel support paths. Each flooring also includes an offload transverse support surface for supporting a row of the tube support members for transverse movement thereof onto an intermediate holding assembly of the onsite transfer apparatus (change assembly to apparatus above). An onload platform device is operable to move a plurality of tube support members to a selected vertical position adjacent each of the floorings of the mobile support unit for transfer of the tube support members on the onload platform device onto the onload transverse support surface of the flooring. An offload platform device is operable to receive a plurality of the tube support members which have been offloaded from one of the floorings to vertically move the tube support members to another vertical level at which the tube support members are advanced along an entry path to the textile machine.

22 Claims, 7 Drawing Sheets

Fig. 4
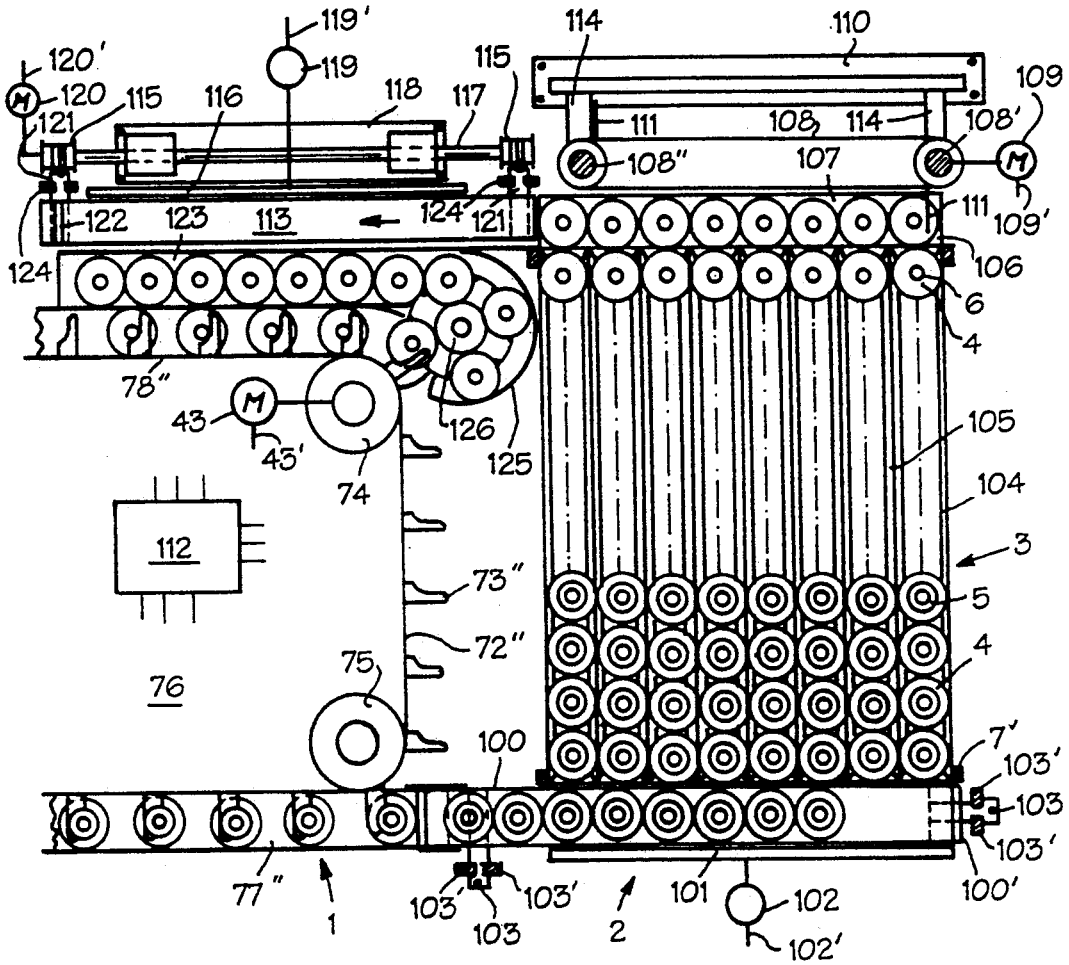
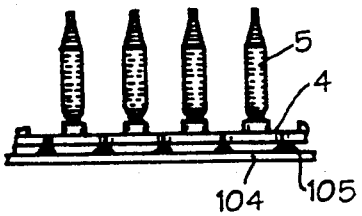
Fig. 4a

FLEXIBLE TRANSPORT SYSTEM FOR GROUPWISE TRANSPORT OF TEXTILE YARN PACKAGES INCLUDING A MOBILE SUPPORT UNIT FOR SHUTTLING TEXTILE YARN PACKAGES BETWEEN TWO TEXTILE MACHINES

BACKGROUND OF THE INVENTION

The present invention relates to a flexible transport system having a mobile support unit for transferring textile yarn packages between textile machines.

U.S. Pat. No. 4,144,961 to Kasahara et al discloses an apparatus for transporting discrete groups of yarn packages supported on trays with the trays being transported between a tray loading location and a textile machine by a mobile unit. A lift mechanism is provided for transferring the trays from the mobile unit to a transport path extending along the textile machine which is at a different vertical level than the trays on the mobile unit. The apparatus disclosed in this patent is operable to discharge all of the trays supported on the mobile unit and, following the discharge of the last tray, to load other trays onto the mobile unit for transport of the trays away from the loading site. For example, the mobile unit can transport a plurality of trays each supporting a plurality of full yarn packages to a textile draw twisting machine and, following the discharge of all of the trays supporting the full yarn packages, other trays, each supporting a group of empty tubes, can be loaded onto the mobile unit for transport away from the draw twisting machine. However, this prior art machine does not flexibly provide the capability to unload trays from the mobile unit while contemporaneously loading other trays onto the mobile unit and, thus, this prior art device does not fully optimize the loading and unloading processes for the operation of a mobile-type textile yarn package transport unit. Accordingly, the need still exists for a mobile transport system which optimizes the loading and unloading processes in which tube support members with empty tubes or yarn packages thereon are loaded onto, and unloaded from, a textile machine.

SUMMARY OF THE INVENTION

The present invention provides a mobile transport system which optimizes the loading and unloading processes at a textile machine.

The transport system of the present invention advantageously provides the capability to simultaneously unload tube support members from a mobile storage or support unit while loading other tube support members onto the mobile storage or support unit. As a result, certain operations at a textile machine which can be performed independently of one another such as, for example, the supplying of empty tubes to the spindles of the spinning stations along one side of a textile ring spinning machine, which can be performed independent of a doffing operation along the other side of the ring spinning machine in which full yarn packages are doffed from the spindles onto tube support members, can be performed without a lag or delay due to the unavailability of tube support members. The transport system of the present invention permits the supply of tube support members supporting empty tubes to be transported to positions adjacent empty spindles along one side of a textile ring spinning machine while, simultaneously, tube support members supporting full yarn packages on the other side of the ring spinning machine are loaded onto a mobile storage or support unit in preparation for further transport of these tube support members with full yarn packages to another location.

Briefly described, the present invention provides, in one aspect thereof, a mobile transport system for the transport of independently movable tube support members to and from a textile machine, the tube support members supporting tubes of the type on which yarn packages are built or unwound. The mobile transport system includes a mobile support unit for temporarily supporting a plurality of tube support members thereon, the mobile support unit being movable to the textile machine for the transfer thereat of the tube support members between the textile machine and the mobile support unit and including means for supporting tube support members in a transfer row during the transfer of the tube support members between the unit and the textile machine and means for guiding tube support members in a plurality of supply rows transverse to the transfer row. Also, the mobile transport system includes means for transferring tube support members between the textile machine and the transfer row supporting means.

According to further features of the one aspect of the present invention, the mobile support unit includes a second means for supporting tube support members in a second transfer row during transfer of the tube support members between the mobile support unit and the textile machine and a second means for guiding tube support members in a plurality of supply rows transverse to the second transfer row, the supply row guiding means and the second supply row guiding means being at least partially superjacent. In another feature of the one aspect of the present invention, there are two said transfer row supporting means at opposite ends of the supply rows, one of the transfer row supporting means being an offload transverse support means operable to support a plurality of tube support members transferred thereto from the supply row guiding means for unloading for delivery to the textile machine and the other being an onload transverse support means for receiving tube support members discharged from the textile machine and tube support members for transfer thereof to the supply rows. Preferably, the offload transverse support component includes a lateral edge extending transversely to the supply rows adjacent the ends of the supply rows and extending downwardly therefrom, and an opposed lateral edge, the tube support members supported on the offload transverse support component being supported between the lateral edges whereby the lateral edges guide the tube support members during unloading.

According to additional features of the one aspect of the present invention, the means for transferring tube support members between the textile machine and the transfer row supporting means includes an intermediate assembly for supporting a plurality of tub support members transferred thereto from a selected one of the textile machine and the transfer row supporting means and intermediate transfer means for transferring a plurality of tube support members supported on the intermediate assembly to the other of the textile machine and the transfer row supporting means. According to yet another feature of the one aspect of the present invention, the system further includes means for moving tube support members between the transfer row supporting means and the supply row guiding means. Additionally, according to other aspects of the yet another feature, the textile machine is at a different vertical level than the transfer row supporting means and the means for transferring tube support members between the textile machine and the transfer row supporting means includes vertical movement means for vertically moving a plurality of tube support members for transfer between the textile machine and the transfer row supporting means. Also, the vertical movement means includes an upper platform for supporting a plurality of tube support members, a lower platform for supporting a plurality of tube support members, a platform frame for mounting the upper and lower platforms in fixed, spaced relation to one another with the platforms being operable to support separate pluralities of tube support members at the same time, and drive means for raising and lowering the platform frame to selectively position the upper and lower platforms at locations for transfer of tube support members between the respective platform and a selected one of the textile machine and the transfer row supporting means.

In yet another aspect of the yet another feature of the present invention, the vertical movement means includes an upper platform for supporting a plurality of tube support members thereon, a lower platform for supporting a plurality of tube support members thereon, and vertical guide means for guiding the upper and lower platforms in generally superposed relation, and drive means for independently raising and lowering each platform.

According to further details of the yet another feature of the one aspect of the present invention, the means for transferring tube support s between the textile machine and the transfer row supporting means includes an intermediate assembly for supporting a plurality of tube support members transferred thereto from a selected one of the textile machine and the transfer row supporting means for subsequent transfer of the tube support members to the other of the textile machine and the transfer row supporting means, intermediate loading means for transferring tube support members between the textile machine and the intermediate assembly, and means for moving tube support members between the intermediate assembly and the transfer row supporting means. Also, the textile machine and the transfer row supporting means are at different vertical levels and the intermediate holding assembly is operable to support tube support members generally at the level of the transfer row supporting means, and the means for transferring tube support members between the textile machine and the transfer supporting means includes vertical movement means for moving tube support members between the intermediate assembly and the textile machine.

According to additional details of the yet another feature of the one aspect of the present invention, the mobile support unit includes a second means for supporting a plurality of tube support members in a second transfer row and second means for guiding tube support members in a plurality of second supply rows transverse to the second transfer row, the first-mentioned supply row guiding means and the second supply row guiding means being at least partially superjacent. Also, the system includes a second intermediate assembly, positioned generally at the level of the second transfer row supporting means, for supporting tube support members thereon for transfer between the second intermediate assembly and the second transfer row supporting means. The vertical movement means is operable to vertically move a plurality of tube support members between the textile machine and a position adjacent the second transfer row supporting means for transfer of tube support members between the vertical movement means and the second transfer row supporting means, and the intermediate loading means is operable to transfer tube support members between the vertical movement means and the first and second intermediate assemblies and means for moving tube support members in the second transfer row from the second transfer row supporting means to the second supply rows.

According to a supplemental feature of the one aspect of the present invention, each tube support member includes a generally cylindrical base portion and an upright portion coaxially mounted on the base portion, and the supply row guiding means includes a plurality of guide members arranged in parallel, spaced relation to one another and each having a base portion and a laterally projecting portion mounted on its base portion. The laterally projecting portion of each guide member extends over the base portion of a tube support member in the associated supply row and the laterally projecting portions of adjacent pairs of the guide members forming a passage therebetween for the passage therethrough of the upright portions of the tube support members to effect guiding of the tube support members in the supply rows.

According to a further additional feature of the one aspect of the present invention, each tube support member includes a generally cylindrical base portion having a generally cylindrical upper component and a tapering lower component tapering inwardly from the upper cylindrical component toward the bottom of the tube support member. Also, the supply row guiding means includes a plurality of guide members arranged in spaced parallel relation to one another to form the supply rows therebetween, and each guide member has a cross-sectional shape compatible with open spaces formed by the tapering lower component of a pair of laterally adjacent tube support members in abutting engagement with one another along their upper cylindrical components.

According to another aspect of the present invention, there is provided a mobile transport system for the transport of independently movable tube support members to and from a textile machine, the tube support members supporting tubes of the type on which yarn packages are built or unwound. The mobile transport system includes a mobile support unit for temporarily supporting a plurality of tube support members thereon, the mobile support unit being movable to the textile machine for transferring tube support members between the textile machine and the mobile support unit and means for transferring tube support members from the textile machine to each of the first and second onload transfer row support means and for transferring tube support members from each of the first and second offload transfer row support means to the textile machine. The mobile support unit includes onload transfer row mean for supporting a plurality of tube support members in a first onload transfer row, and first means for guiding tube support members in a plurality of first supply rows transverse to the first onload transfer row. Also, the unit includes first offload transfer support mean for supporting a plurality of tube support members in a first offload transfer row, the first onload transfer row support means and the first offload transfer row support means being adjacent opposite ends of the first supply row guiding means, and second onload transfer row support means for supporting a plurality of tube support members in a second onload transfer row. Additionally, the unit includes second offload transfer row support means for supporting a plurality of tube support members in a second offload transfer row, and second means for guiding tube support members in a plurality of second supply rows transverse to the second onload transfer row, the second onload transfer row support means and the second offload transfer row support means being adjacent opposite ends of the second supply row guiding means.

Preferably, in the another aspect of the present invention, the first onload transfer row, first supply rows, and first offload transfer row are disposed in a generally horizontal first plane, and the second onload transfer row, second supply rows, and second offload transfer rows are disposed in a generally horizontal second plane. Also, the means for transferring tube support members between the textile machine and the first and second onload transfer row support means preferably includes a first intermediate assembly, positioned generally at the level of the first onload transfer row for supporting a plurality of tube support members for transfer to the first onload transfer row, and a second intermediate assembly, positioned generally at the level of the second onload transfer row for supporting a plurality of tube support members for transfer thereof to the second onload transfer row support. Also, the means for transferring includes, preferably, onload vertical movement means for vertically moving a plurality of tube support members from the textile machine to a position adjacent at least one of the first and second onload intermediate assemblies for transfer of tube support members and the respective onload intermediate assembly.

According to additional features of the another aspect of the present invention, the means for transferring tube support members from the first and second offload transfer row support means to the textile machine includes a first offload intermediate assembly, positioned generally at the level of the first offload transfer row for supporting a plurality of tube support members transferred thereto from the first offload transfer row, a second intermediate assembly, positioned generally at the level of the second offload transfer row for supporting a plurality of tube support members transferred thereto from the second offload transfer row, and offload vertical movement means for vertically moving a plurality of tube support members transferred thereonto from at least one of the first and second offload intermediate assemblies to the textile machine. Also, the system preferably includes first onload ejector mean for groupwise transfer of a plurality of tube support members supported on the onload vertical movement means to the first onload intermediate assembly and second onload ejector means for groupwise transfer of a plurality of tube support members supported on the onload vertical movement means onto the second onload intermediate assembly.

According to a further feature of the another aspect of the present invention, the overlapping portion of each of the guide members has an end portion adjacent the transfer row supporting means and the end portion includes a guide profile for guiding tube support members into the spacing between each adjacent pair of the overlapping portions of adjacent guide members.

BRIEF DESCRIPTION OF THE DRAWINGS

FIG. 4 is a top plan view of another embodiment of the transport system of the present invention and showing a portion of a textile machine for receiving tube support members from, and transferring tube support members to, the mobile support unit of the transport system;

FIG. 4*a* is side elevational view of a portion of the mobile support unit shown in FIG. 4;

DESCRIPTION OF THE PREFERRED EMBODIMENT

Figure 1:
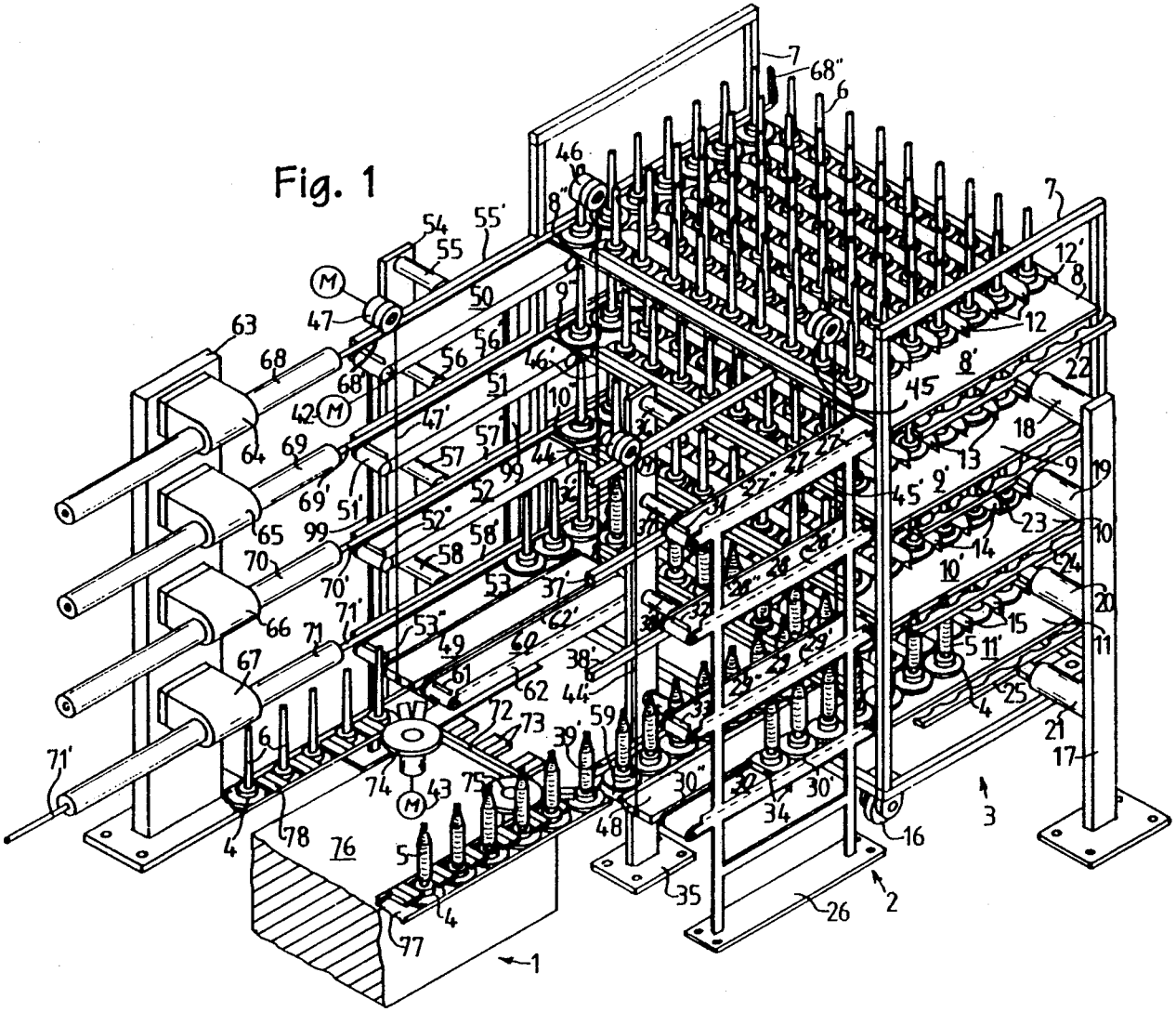
FIG. 1 is a perspective view of one embodiment of the transport system of the present invention at a transfer location adjacent a textile machine for transfer of tube support members therebetween.
Figure 2:
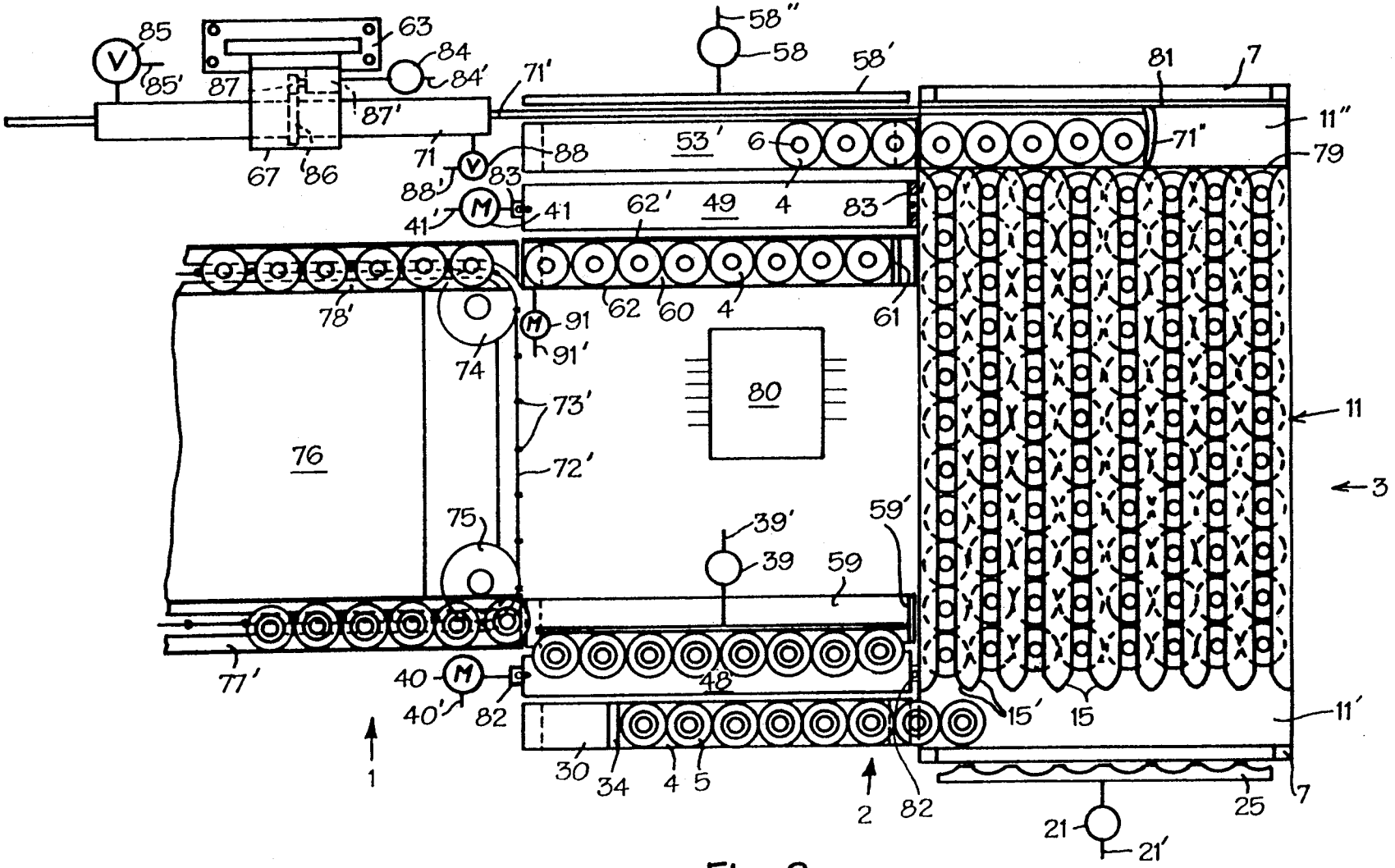
FIG. 2 is a top plan view of the transport system and the portion of the textile machine shown in FIG. 1.
Figure 3:
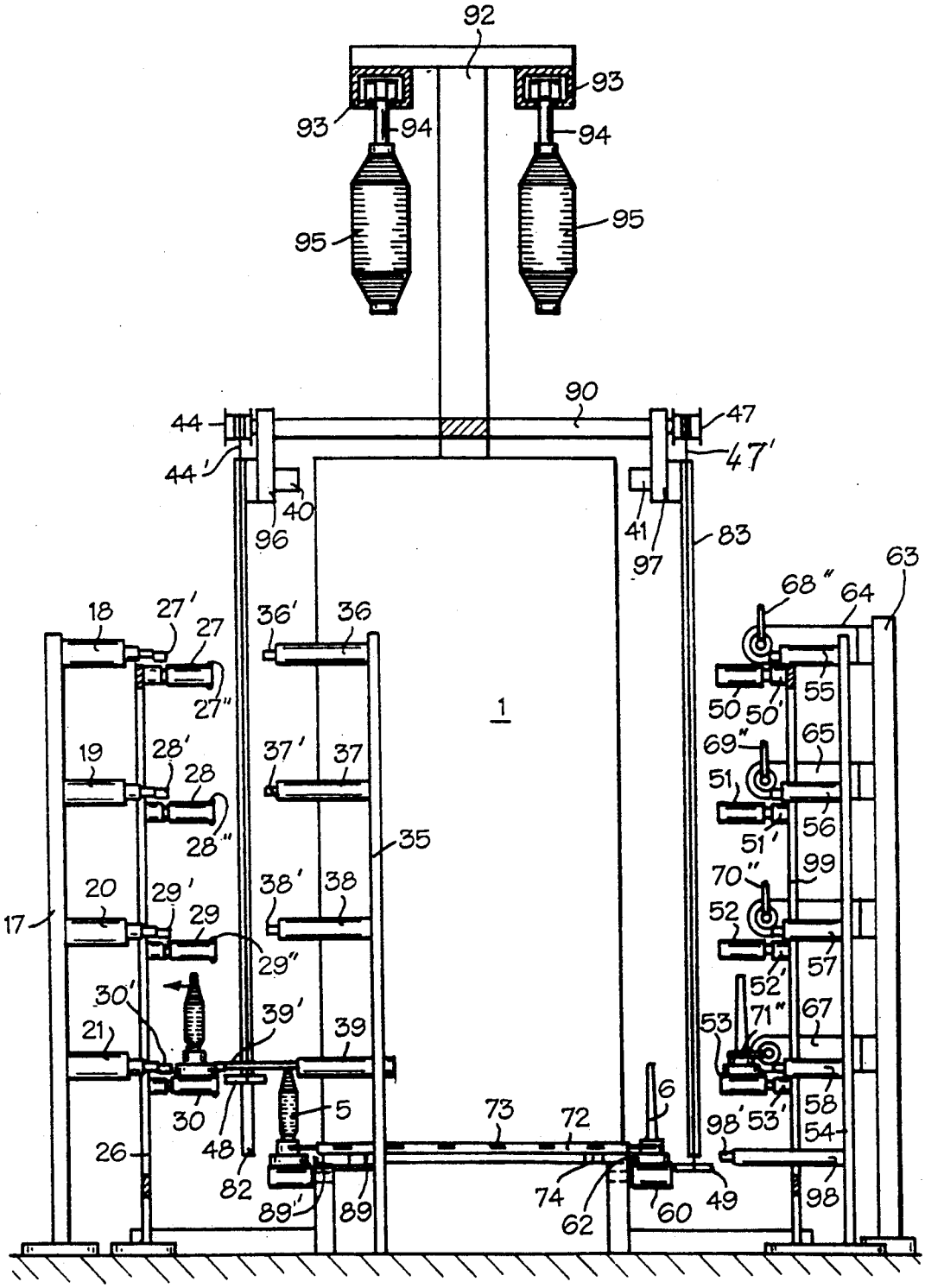
FIG. 3 is a side elevational view of one variation of the onsite transfer means of the transport system shown in FIGS. 1 and 2, showing the onsite transfer means with the mobile support unit displaced from its transferring position adjacent the onsite transfer means.

In FIGS. 1–3, one embodiment of the transport system of the present invention is illustrated. The transport system is operable to transport a plurality of tube support members 3 between one textile machine and another textile machine spaced from the one textile machine with the tube support members 3 each supporting an empty tube 6 or a full yarn package 5 comprising yarn built on a tube. The one textile machine can be, for example, a textile spinning machine 1, a portion of which is shown in FIGS. 1 and 2, and the another textile machine can be, for example, a machine for performing a subsequent handling operation on the yarn packages built at the spinning machine 1. The another textile machine is not shown.

The textile spinning machine 1 includes a conventional endless belt transport assembly for transporting the tube support members 4 to positions adjacent the spinning stations of the machine whereat a tube or yarn package exchange process occurs in which empty tubes 6 supported on the tube support members 4 are transferred from the tube support members to the empty spindles of the spinning stations in a tube exchange process or full yarn package 5 on the spindles are transferred to empty ones of the tube support members 4 positioned adjacent the spinning stations in a yarn package exchange process. The endless belt transport assembly of the textile spinning machine 1 includes an endless belt 72 having a plurality of sets of carrier members 73 mounted thereto in pairs at uniform spacings from one another. The each adjacent pair of the sets of the carrier members 73 form a receiving space therebetween in which the neck portion of a tube support member 4 is received for sliding transport of the tube support member along an exit support surface component 77 and an entry support surface 78.

The endless belt 72 is trained around a plurality of guide rollers 75 (only on of which is shown in FIGS. 1 and 2) and a single drive roller 74 which, as seen in FIG. 1, is operatively connected to a conventional drive motor 43 for driving operation of the belt 72. The endless belt transport assembly of the textile spinning machine transport the tube support members 4 supporting full yarn packages 5 doffed thereonto from the spinning stations along the exit sliding support component 77 to an exit location at which the tube support members are transferred to the transport system of the present invention. The entry sliding support component 78 receives the tube support members 4 transferred at an exit location for transport of the transferred tube support members, each supporting an empty tube 6, to positions adjacent the spinning stations of the textile spinning machine 1 for transfer of the empty tubes 6 thereto. As seen in FIG. 3, the textile spinning machine 1 includes a creel frame 92 having a pair of rails 93 for rolling travel therealong of a plurality of flyer packages 95 each suspended from the rails 93 by a suspension member 94.

The transport system includes a mobile support unit 3 for temporarily supporting a plurality of the tube support members 4 thereon Each tube support member 4 includes a cylindrical base portion, a neck portion of lesser diameter than its base cylindrical portion, and a cylindrical post of lesser diameter than the neck portion. The post and the neck portion are co-axially mounted to the base cylindrical portion with the neck portion being mounted intermediate the post and the base cylindrical portion. The post is of a diameter selected with respect to the inside diameter of a tube 6 for snugly receiving a tube inserted thereon.

The mobile support unit 3 is preferably configured for rolling travel between the spinning machine and the another textile machine and, in this regard, the mobile support unit 3 includes a frame assembly 7 having a parallelopiped shape. A rolling wheel assembly 16 is mounted to each of the four corners of the underside of the frame assembly 7 and the rolling wheel assembly 16 (only one of which is shown in FIG. 1) are preferably provided with conventional wheel locking means for locking the rolling wheel of each assembly against rolling travel to facilitate the secure parking of the mobile support unit 3 that transfer locations adjacent the textile machines.

The mobile support unit 3 also includes a means for guiding the tube support members 4 in a plurality of supply rows, the supply row guiding means being in the form of a plurality of shelf means 8–11 for supporting the tube support members 4 thereon in generally horizontal dispositions. Each shelf means includes a rectangular planar flooring 8–11, the floorings being mounted to the frame assembly 7 in superposed relation to one another with spacing between each adjacent pair of the floorings sufficient to permit the free travel of the tube support members 4 supporting the tube 6 and the yarn packages 5 along each flooring without interference with the next higher flooring. A plurality of guide members 12–15 are mounted to each of the floorings 8–11 for maintaining and guiding the tube support members 4 in a plurality of parallel guided support paths on the floorings.

The guide members 12–15 each have a cross-sectional T-shape comprised of a horizontal overlapping component mounted along its center to the top of a vertically extending, parallel base component. The horizontal overlapping component is at a height above the respective flooring 8–11 slightly greater than the axial extent of the base circumferential portion of a tube support member and the lateral extent of the horizontal overlapping component is selected relative to the diameter of the base circumferential portion and the neck portion of a tube support member 4 such that the neck portion of the tube support members extends upwardly between the horizontal overlapping components of each adjacent pair of the guide members 12–15 with the horizontal overlapping components extending over a portion of the base circumferential portion of each tube support member.

As seen in particular in FIG. 2, each of the guide members 12–15 such as, for example, the guide member 15, is formed a with a convex end portion 15′ for facilitating the guiding of the tube support members 4 into the guided support paths formed between the adjacent pairs of the guide members 12–15 in a manner described in more detail below.

The guide members 12–15 are each of a length less than the length of the floorings 8–11 and are centrally mounted thereon so as to provide a transverse support component on each flooring adjacent each respective end of the guide members of the flooring. As seen in FIG. 2, each of the floorings 8–11 includes means for supporting a row of the tube support members 4 in a transfer row in the form of an onload transverse support surface 11′ extending transversely to the guided support paths adjacent the open ends thereof for supporting, in at least one transverse row, a plurality of the tube support members 4 for subsequent transfer thereof to the guided support paths. Additionally, each of the floorings 8–11 includes an offload transverse support surface 8″–11″, respectively, extending transversely to the guided support paths adjacent their other ends for supporting, in at least one transverse row a plurality of the tube support members transferred thereto from the guided support paths. Each of the floorings 8–11 is preferably provided with a raised portion (not shown) along the outward lateral edge of each of the onload transverse support surfaces 8′–11′ and the offload transverse support surfaces 8″–11″ for preventing the movement of the tube support members 4 laterally beyond the ends of the flooring.

The mobile support unit 3 is operable to travel independently as a discrete unit with each of the floorings 8–11 supporting several rows of the tube support members 4 with each row of the tube support members extending along one of the guided support paths formed by the guide members 12–15. In order to effect the transfer of the tube support members 4 between the respective textile machine and the mobile support unit 3, the transport system also includes a means for transferring the tube support members 4 between the textile spinning machine 1 and the offload an onload transverse support surfaces in the form of an onsite transfer means 2. The onsite transfer means 2 is operable to load the tube support members 4 delivered thereto by the textile machine onto the floorings 8–12 and is operable to discharge or offload the tube support members 4 from the mobile support unit 3 to an entry location at which the textile machine takes over the transport of the tube support members 4 to effect the efficient loading of the tube support members from the textile machine onto the floorings 8–12. The onsite transfer means 2 includes, as described in more detail below, several onload components which optimize the efficient and rapid loading of the tube support members 4. As seen in FIGS. 1 and 2, a plurality of supply row movement means, in the form of shelf path movement means, for moving the tube support members 4 on the guided support paths onto the transverse support surfaces. The shelf path movement means is in the form of a plurality of hydraulic and piston assemblies 18–21, each having a guide bar 22–25, respectively, mounted to the free end of its piston. As seen in FIG. 1, the cylinder of each of the hydraulic cylinder and piston assemblies 18–21 is fixedly mounted to an upright frame 17 with the cylinder extending horizontally therefrom for selectively extending and retracting its associated guide bar in a direction parallel to the guided support paths.

As seen in FIG. 2, each of the guide bars 22–25 such as, for example, the guide bar 25 associated with the hydraulic cylinder and piston assembly 21 is formed with a plurality of arcuate recesses compatibly shaped with the circumference of the base cylindrical portion of a tube support member 4 and positioned at spacings along the guide bar in coordination with the spacings of the guided support paths for stably guiding a tube support member 4 supported on the onload transverse support surface 11' into one of the guided support paths during extension of the guide bar 25. The convex end portions 15' of the guide members facilitate the reliable entry of the tube support members 4 into the guided support paths during the movement thereof by the guide bar 25.

To effect the smooth transfer of the tube support members 4 from the exit sliding support component 77 at the exit location to the transport system of the present invention, the onsite transfer means 2 includes an onload ramp 59 extending horizontally at the same height as the exit sliding component 77 and having, as seen in FIG. 2, a stop member 59' at its end remote from the exit location for preventing the travel of the tube support members 4 therepast. The onload ramp 59 is aligned with the exit sliding support components 77 for smooth sliding transfer of the tube support members 4 at the exit location onto the onload ramp with each subsequently arriving tube support member 4 being moved into abutting engagement with the just-delivered tube support member to effect sliding movement of the just-delivered tube support member along the onload ramp. As seen in FIG. 2, the onsite transfer means includes an onload vertical movement means for interconnecting the exit path formed by the onload ramp 59 with the floorings 8–11 in a manner such that the tube support members 4 transferred from the textile spinninq machine 1 are reliably onloaded on to the floorings 8–11. The onload vertical movement means includes an onload vertical platform means for vertically moving a plurality of the tube support members 4 to different vertical positions for transfer thereof to a plurality of intermediate holding assemblies 27–30, in like number as the floorings 8–11 of the mobile support unit 3. The intermediate holding assemblies 27–30 are each operable to temporarily support and subsequently transfer a plurality of tube support members to a respective one of the transverse support surfaces 8'–11' of the floorings 8–11. The onload vertical platform means is movable between a receipt position adjacent the onload ramp 59 and a transfer position adjacent each one of the intermediate holding assemblies 27–30 for the transfer of the tube support members 4 from the onload ramp 59 to the selected intermediate onload holding assembly.

Each of the onload intermediate holding assemblies 27–30 includes an endless belt trained around a conventional guide roller and a conventional drive roller, each drive roller being operatively connected to a conventional drive motor (not shown) for driving operation of the endless belt. The guide rollers and the drive rollers are rotatably mounted on an onload intermediate holding assembly frame 26. Each onload intermediate holding 27–30 includes a wall 27'–30', respectively, for preventing lateral movement of the tube support members supported on the endless belt of the holding assembly laterally beyond the endless belt. Each endless belt of the onload intermediate holding assemblies 27–30 has an upper run extending horizontally at generally the same vertical height as the associated one of the floorings 8–11 to which the tube support members 4 are transferred.

Each of the onload intermediate holding assemblies 27–30 includes a pair of belt clearing members 31–34, respectively, each belt clearing member extending laterally across the endless belt of the assembly and being spaced from the other belt clearing member of the respective pair at equi-distant spacings as measured in both directions of the endless belt. The belt clearing members 31–34 move in correspondence with the travel of the endless belt and thereby push the tube support members supported on the endless belt onto the adjacent onload transverse support surface 8'–11'' of the respective associated flooring 8–11.

The onload vertical platform means includes an onload platform 48 having the capacity to receive the plurality of the tube support members 4 transferred thereto from the onload ramp 59 and a pair of platform lift cables 44',45', each secured to a respective end of the onload platform 48 and selectively windable onto, and unwindable from, a winding roller 44,45, respectively, supported on a frame comprised of a pair of vertical guide channels 82 (see FIG. 3). The winding roller 44 is operatively connected to a drive motor 40, as seen in FIG. 3, for winding and unwinding rotation of the winding roller 44. A conventional rotation transmitting device (not shown) is operatively connected between the winding roller 44 and the winding roller 45 to effect winding and unwinding movement of the winding roller 45 in correspondence with the winding and unwinding movement of the winding roller 44.

As seen in FIG. 2, each of the platform lift cables 44',45' is guided in one of the pair of the vertical guide channels 82. The vertical guide channels 82 insure that the onload platform 48 travels in a vertical travel path during winding and unwinding of the platform lift cables. Through selective winding and unwinding of the platform lift cables 44',45', the onload platform 48 is selectively positioned adjacent each of the onload intermediate holding assemblies 27–30 for the transfer of the tube support members 4 supported on the onload platform 48 to the endless belt of the adjacent assembly.

To effect the initial loading of the onload platform 48 with tube support members from the onload ramp 59, the onsite transfer means 2 includes a hydraulic cylinder and piston assembly 39, as seen in FIG. 2, having a linear guide bar 39', as seen in FIG. 1, for groupwise engagement of the tube support members 4 on the exit path formed by the onload ramp 59. The linear guide bar 39' is selectively extended in a single length extending movement, as seen in FIG. 2, by the hydraulic cylinder and piston assembly 39 to effect groupwise transfer of the tube support members 4 from the exit path onto the onload platform 48 when the onload platform 48 is positioned adjacent the onload ramp 59. In the event that the group of tube support members 4 on the onload ramp 59 are to be loaded onto the lowermost onload intermediate holding assembly 30, which is at the same vertical level as the onload ramp 59, the hydraulic cylinder and piston assembly 39 is controlled to extend the linear guide bar 39' in a double length extending movement twice the length of its single length extending movement to move the tube support members 4 completely laterally beyond the onload platform 48 onto the endless belt of the intermediate holding assembly 30. On the other hand, if the tube support members 4 on the onload ramp are to be transferred to one of the other onload intermediate holding assemblies 27-29, the tube support members 4 are initially transferred by the linear guide bar 39' from the onload ramp 59 onto the onload platform 48. Thereafter, the winding rollers 44,45 are controlled to wind the platform lift cables 44',45' to effect lifting of the onload platform 48 to a vertical level adjacent the respective one of the onload intermediate holding assemblies 27-29 to which the tube support members are to be transferred. Preferably, the vertical guide channels 82 are provided with contact members operatively connected to the drive motor 40 to signal the arrival thereout of the onload platform 48 to the drive motor, whereby the winding operation of the winding rollers 44,45 can be stopped in correspondence with the arrival of the onload platform 48 adjacent the respective onload intermediate holding assembly.

To effect the transfer of the tube support members on the onload platform 48 onto the respective onload intermediate holding assembly 27-29 to which the onload platform has been raised, the onsite transfer means includes a plurality of onload ejector means 36-38, as seen in FIG. 1. Each onload ejector means 36-38 is in the form of a hydraulic cylinder and piston assembly having a linear guide bar 36'-38', respectively, fixedly mounted to the free end of its piston. The cylinders of the hydraulic cylinder and piston assemblies 36-38 are fixedly mounted to a frame 35 at spacings from one another in correspondence with the vertical spacings of the onload intermediate holding assemblies 27-29 such that each linear guide bar 36'-38' is movable in a horizontal plane generally at the same vertical level as the plurality of tube support members supported on the onload platform 48 adjacent the respective onload intermediate holding assembly to push the tube support members onto the adjacent endless belt of the respective assembly.

Each of the onload intermediate holding assemblies 27-30 includes an onload support wall 27''-30'' on the respective lateral side of its endless belt at which it receives the tube support members from the onload platform 48. The onload support wall 27''-30'' is of a height sufficient to permit travel of the respective linear guide bar 36'-39' thereover, yet extends sufficiently above the upper run of the associated endless belt to provide lateral guiding of the tube support members 4 transferred to the respective onload intermediate holding assembly.

The onload components of the onsite transfer means operate as follows to transfer the tube support members 4 from the textile spinning machine 1 to the mobile support unit 3. As each tube support 4 is transported beyond the exit sliding support component 77 at the exit location, a tube support member which supports a full yarn package 5 doffed from a respective spinning station of the textile spinning machine 1 is advanced onto the onload ramp 59 by the action of the subsequently arriving tube support members being discharged at the exit location. Once the onload ramp 59 has a full complement of tube support members 4 thereon, the hydraulic cylinder and piston assembly 39 is operated to extend the linear guide bar 39'' in a double extension in which the tube support members 4 are pushed laterally over and beyond the adjacent onload platform 48 onto the lowermost onload intermediate holding assembly 30 or it is extended in a single extension to push the tube support members 4 onto the onload platform 48. If the tube support members 4 are loaded on the onload platform 48, the onload platform is lifted as described above to a position adjacent one of the other onload intermediate holding assemblies 27-29 and, thereafter, the associated hydraulic cylinder and piston assembly 36-38 is operated to push the plurality of tube support members onto the adjacent endless belt of the respective onload intermediate holding assembly.

The complement of the tube support members 4 on the respective onload intermediate support assembly 27-30 is then transferred to the onload transfer support surface 8'-11' of the respective one of the floorings 8-11 adjacent the intermediate holding assembly by operation of the endless belt of the intermediate holding assembly by which the respective pair of belt clearing members 31-34 pushes the endmost one of the tube support members 4 on the endless belt to effect sequential abutting engagement of the tube support members with one another onto the adjacent onload transverse support surface. For example, as seen in FIG. 1, one of the belt clearing members 34 of the lowermost onload intermediate holding assembly 30, which has traveled with the endless belt approximately halfway along its travel on its upper run, has pushed some of the tube support members 4 onto the onload transverse support surface 11' of the flooring 11. As the respective belt clearing members completes it travel along the upper run of the endless belt, the other belt clearing member associated with the endless belt moves into a preliminary position such as, for example, the position of the belt clearing members 31-33 shown in FIG. 1, in position for engaging a next group of tube support members 4 to be transferred to the endless belt.

Once a plurality of tube support members 4 have been transferred onto an onload transverse support surface 8'-11', the associated one of the hydraulic cylinder and piston assemblies 18-21 of the shelf movement means is operated to load the tube support members 4 into the guided support paths. If the guided support paths are fully loaded with tube support members 4, the movement of another plurality of tube support members 4 into the guided support path creates a chain reaction effect in which the tube support members at the other end of the guided support path are pushed out onto the respective one of the offload transverse support surfaces 8''-11''. To effect the discharge or offloading of these tube support members 4 which have been pushed onto the offload transverse support surface 8''-11'', the onsite transfer means 2 includes a plurality of offload components including, as seen in FIG. 1, a plurality of offload intermediate holding assemblies 50-53, each comprising an endless belt trained around a conventional guide roller and a conventional drive roller. The guide rollers and the drive rollers are rotatably mounted on an offload frame 54 and each drive roller such as, for example, the drive roller associated with the endless belt of the offload intermediate holding assembly 50, is operatively connected to a drive motor 42, as seen in FIG. 1, for driving operation of the endless belt. Each endless belt includes a remote end stop members 50"-53", respectively, for preventing movement of the tube support members 4 loaded on the endless belt beyond the end of the endless belt remote from the mobile support unit 3. Each of the remote end stop members 50"-53" is mounted to the offload frame 54 independently of the associated endless belt.

The onsite transfer means also includes means for moving a transfer row of tube support members of one of the offload transverse support surfaces 8"-11" onto the offload intermediate holding assemblies 50-53 in the form of an offload transverse movement means comprising a plurality of hydraulic cylinder and piston assemblies 68-71. Each hydraulic cylinder and piston assembly 68-71 is each individually rotatably mounted in a housing 64-67, respectively, and the housing 64-67 are fixedly mounting to a frame 63. Each hydraulic cylinder and piston assembly 68-71 includes a selectively extendable and retractable piston rod 68'-71', respectively, having an upturned free end 68"-71", respectively. Each piston rod 68'-71' is mounted in its respective cylinder for axial movement relative thereto but is secured rotational or angular movement with respect to its cylinder.

Each hydraulic cylinder and piston assembly 68-71 is operable to transfer a plurality of tube support members 4 from one of the offload transverse support surfaces 8"-11" to the endless belt of the associated one of the offload intermediate holding assemblies 50-53 in the following manner. The piston rod 68'-71' is extended outwardly from its cylinder such that its upturned end 68'-71', respectively, extends beyond the endmost one of the plurality of the tube support members supported on the mobile support unit 3 such as, for example, the upturned end 68" of the piston rode 68'. To insure non-interfering extending movement of the piston rods 68'-71', the upturned ends 68"-71" of the piston rods is maintained in its vertically upright position during extension of the piston rod.

Once the upturned end 68"-71" is positioned in its most extended position, the housing 64-67 associated with the respective hydraulic cylinder and piston assembly 68-71 is controlled to rotate the cylinder and its piston rod through a 90° angular movement to thereby effect movement of the upturned end 68"-71" from a vertically upright position to a horizontally-oriented position. The cylinder associated with the respective piston rod 68'-71' is then controlled to effect retraction of the piston rod and the upturned end 68"-71" engages the endmost one of the plurality of the tube support members 4 supported on the respective offload transverse support surface 8"-11". Since the tube support members 4 abut one another in a chain reaction manner in response to engagement of the endmost one by the respective upturned end 68"-71", the plurality of the tube support members 4 move from the offload transverse support surface 8"-11" onto the endless belt of the associated offload intermediate holding assembly 50-53 and the endless belt is operated in coordination with the movement of the tube support members 4 thereonto to insure a reliable and smooth transfer of the tube support members onto the endless belt. The remote end stop member 50'-53' prevents movement of the frontmost one of the advancing tube support members 4 beyond the endless belt.

As seen in FIG. 2, each of the housing 64-67 such as, for example, the housing 67, houses a driven gear 86 fixedly mounted to the circumference of the respective cylinder of the cylinder and piston assembly 68-71 associated with the housing and a drive gear 87 rotatably mounted in a gear box 87'. The gear box 87' is fixedly mounted to the frame 63. The shaft of a drive motor 84 is operatively connected to the drive gear 87 and the drive gear 87 is meshingly engaged with the driven gear 86 to transmit rotation of the shaft of the drive motor 84 to the driven gear 86 and correspondingly to the associated cylinder. Also, each cylinder of the hydraulic cylinder and piston assemblies 68-71 is operatively connected to a conventional pneumatic source 85, as seen in FIG. 2.

The onsite transfer means also includes offload ejector means comprising a plurality of hydraulic cylinder and piston assemblies 55-58 each having a linear guide bar 55'-58' fixedly secured to the free end of its piston. The hydraulic cylinder and piston assemblies 55-58 are operable to selectively extend their associated linear guide bars 55'-58' to push a plurality of the tube support members on the endless belt of the associated one of the offload intermediate holding assemblies 50-53 onto an offload platform of an offload platform means. The offload platform means also includes a pair of platform lift cables 46',47', each connected to a respective end of the offload ramp 49, and selectively windable onto, and unwindable from, a winding roller 46,47, respectively. The winding rollers 46,47, as seen in FIG. 3, are rotatably mounted to the offload frame 54 and the winding roller 47 is operatively connected to a conventional drive motor 41 for driving operation of the winding roller. A conventional rotation transmission device (not shown) operatively interconnects the winding roller 46 with the winding roller 47 to effect rotation of the winding roller 46 in correspondence with the rotation of the winding roller 47. As seen in FIG. 2, the platform lifting cables 46',47' are each guided in a vertical guide channel 83 to insure stable vertical travel of the offload platform 49.

As seen in FIG. 3, the drive motor 40 for driving rotation of the winding roller 44 and the winding roller 44 are each secured to a frame piece 96 which is, in turn, secured by an anchor piece 90 to the creel frame 92 of the textile spinning machine 1. As seen in FIG. 3, the winding roller 47 and the drive motor 41 are each secured to a frame piece 97 which, in turn, is secured to the anchor piece 90.

The onsite transfer means also includes exit path means in the form of an endless belt 60 trained around a conventional guide roller (not shown) and a conventional drive roller for driving operation of the endless belt 60. A lateral wall member 62 extends along one lateral side of the endless belt 60 and another lateral wall member 62' extends along the other respective lateral side of the endless belt. The endless belt 60 includes a pair of belt clearing members 61. As seen in FIG. 1, the endless belt 60 has an upper run extending horizontally at the same vertical level at the entry sliding support components 78 of the textile spinning machine 1 for smooth and reliable transfer of tube support members 4 at the exit location to the textile spinning machine.

The offload components of the offsite transfer means operate as follows to transfer each plurality of the tube support members 4 supported on the offload intermediate support assemblies 50-53 to the textile spinning machine 1. Each time it is desired to clear one of the offload intermediate holding assemblies 50-53 of a plurality of tube support members 4 which have been transferred thereto from the associated one of the floorings 8–11, the offload platform 49 is raised or lowered, as necessary, to a receipt position adjacent the respective offload intermediate holding assembly 50–53 and the one hydraulic cylinder and piston assembly 55–58 associated with the respective offload intermediate holding assembly is controlled to extend its respective linear guide bar 55'–58' in an extending movement completely laterally across the endless belt of the respective offload intermediate holding assembly. This extending movement of the respective linear guide bar 55'–58' effects groupwise transfer of the respective plurality of the tube support members 4 onto the adjacent offload ramp 49.

The offload ramp 49 is then lowered to its lowermost position adjacent the entry path formed by the endless belt 60 and the hydraulic cylinder and piston assembly 58 is controlled to extend its linear guide bar 58'' in a double extension movement in which the linear guide bar 58' is extended completely laterally across the lowermost offload intermediate holding assembly 53 and completely laterally across the offload ramp 49 to thereby effect groupwise transfer of the respective plurality of the tube support members 4 on the offload ramp onto the endless belt 60. The endless belt 60 is then operated to transfer the tube support members 4 thereon to the transport assembly of the textile spinning machine 1. If the transport device of the textile spinning machine 1 includes an arrangement such as illustrated in FIG. 1 in which each tube support member 4 is individually retained by carrier members or the like for transport along the textile spinning machine, the operation of the endless belt 60 can be controlled to intermittently advance the tube support members in the direction of the textile spinning machine in coordination with the intermittent arrival at the entry location of the next available tube support member receiving space between carrier member. The pair of belt clearing members 61 on the endless belt 60 facilitate the advancing movement of the tube support members along the belt by engaging the endmost one of the tube support members.

In the event that a plurality of tube support members are to be transferred from the lowermost offload intermediate holding assembly 53, the offload ramp 49 is positioned at its lowermost position intermediately between the endless belt of the offload intermediate holding assembly 53 and the belt 60 and the hydraulic cylinder and piston assembly 58 is operated to extend its linear guide bar 58' in a double extending movement to effect transfer of the plurality of the tube support members 4 completely across the offload ramp 49 onto the belt 60.

FIG. 2 also illustrates one variation of the transport assembly for transporting the tube support members 4 around the periphery of the textile spinning machine 1. In this variation, in lieu of the endless belt 72 having a plurality of uniformly spaced pairs of carrier members 73, the transport assembly includes an endless belt 72' having a plurality of carrier posts 73' secured thereto at uniform spacings along the endless belt. Additionally, an exit sliding support component 78' is provided in lieu of the exit sliding support component 78 and includes a pair of opposed flanges which form a central slot therebetween through which the neck portion of the tube support members travels during movement of the tube support members by the carrier post 73'. The transport system of the present invention operates in the same manner as described above to load and offload the tube support members 4 transferred between the textile spinning machine and the transport system.

As seen in FIG. 3, the onsite transfer means 2 of the transport system can also be configured to handle the transfer of the tube support members 4 which are transported along the textile spinning machine 1 by a transport assembly which is at a different vertical level than any of the intermediate holding assemblies of the onsite transfer means. For example, as seen in FIG. 3, if the transport assembly of the textile spinning machine 1 is at a vertical level lower than any of the intermediate holding assemblies of the onsite transfer means, the onsite transfer means is supplemented with an additional pair of hydraulic cylinder and piston assemblies 89,98. The hydraulic cylinder and piston assembly 89 is arranged adjacent the exit path along the onload ramp 59 and includes a linear guide bar 89' for effecting groupwise transfer of the tube support members 4 on the onload ramp 59 onto the onload platform 48. The hydraulic cylinder and piston assembly 89 is disposed below the hydraulic cylinder and piston assembly 39 which, in contrast to its operation with the embodiment shown in FIG. 1, operates in the variation shown in FIG. 3 in the same manner as the other hydraulic cylinder and piston assemblies 36–38 of the onload ejector means to displace pluralities of the tube support members 4 from the onload platform 59 onto the associated onload intermediate holding assembly 30.

The other additional hydraulic cylinder and piston assembly 98 is secured to the offload frame 54 and includes a linear guide bar 98' for effecting groupwise transfer of a plurality of the tube support members 4 supported on the offload platform 89 onto the belt 60 forming the entry path.

In FIGS. 4 and 4*a*, another embodiment of the transport system of the present invention is illustrated. The transport system includes a mobile support unit 3 configured with a plurality of floorings arranged in superposed relation to one another in the same manner as the floorings 8–11 of the mobile support unit 3 described with respect to the embodiment illustrated in FIG. 1. Only a single flooring 104 is shown in FIG. 4, it being understood that the other floorings are identically configured. As seen in FIG. 4*a*, the flooring 104 includes a plurality of guide members 105 arranged in parallel spaced relation to one another with each adjacent pair of the guide members forming a guided support path therebetween for supporting and guiding a plurality of the tube support members 4 o the flooring. The guide members 105 are constructed of a cross-sectional shape specifically compatible with the shape of the base cylindrical portions of the tube support members 4.

The tube support members 4 to be transported by the embodiment of the transport system illustrated in FIGS. 4 and 4*a* each comprise a base cylindrical portion, as seen in FIG. 4*a*, having a cylindrical upper portion and a tapering lower portion tapering inwardly from the upper cylindrical portion to an annular bottom surface having a lesser diameter than the diameter of the upper cylindrical portion. Each of the guide members 105 is formed with a cross-sectional shape corresponding to the generally triangular opening formed by the tapering lower portions of a pair of tube support members 4 in abutting engagement with one another along their upper cylindrical portions such that the tube support members 4 in adjacent guided support paths are in abutting contact with one another across the tops of the guide members 105 and the tapering lower portions of the tube support members are in engagement with the guide members 105.

The transport system illustrated in FIGS. 4 and 4*a* also includes an onsite transfer means for transferring the tube support members between the mobile support unit 3 and the textile spinning 1. In this embodiment, the onsite transfer means 2 does not include any intermediate holding assemblies such as described with respect to the embodiment of the transport system illustrated in FIG. 1. Instead, the onsite transfer means 2 includes an onload platform means 100 which functions as onload transverse support component for supporting the tube support members 4 adjacent the guided support paths of the mobile support unit 3. Additionally, each of the floorings of the mobile support unit 3 includes an offload transverse support component such as, for example, the offload transverse support component 107 of the flooring 104 the onsite transfer means includes an offload platform means 113 which cooperates with the respective offload transverse support component of each of the floorings of the mobile support unit 3 for transferring the tube support members 4 from the mobile support 3 to the textile spinning machine 1.

The textile spinning machine 1 illustrated in FIG. 4 includes another variation of a transport device for transporting the tube support members 4 along the spinning machine. In this variation of the transport device, an endless belt 72" has a plurality of carrier members 73" mounted thereto at uniform spacings therealong. Each of the carrier members 73" includes an arcuately shaped portion compatibly configured with the neck portion of a tube support member 4 for engagement therewith to effect sliding movement of the tube support members along an entry sliding support component 78" and an exit sliding support component 77".

The onload platform means 100 includes a platform having a substantially smooth surface for permitting ease of travel of the tube support members 4 thereover. The platform is guided by a pair of vertical guide rails 103 with one of the guide rails being located adjacent one respective end of the platform generally along the lengthwise axis of the platform and the other vertical guide rail being disposed adjacent the other end of the platform transversely to the lengthwise axis thereof. Each vertical guide rail 103 guides one of a pair of carrier brackets 103' mounted to the platform for sliding travel of the platform therealong during vertical movement of the platform. A lift cable is secured at each end to the platform and has its other end secured to a conventional winding roller (not shown) for winding and unwinding of the lift cable to effect vertical movement of the platform.

The onsite transfer means also includes shelf movement means for moving the tube support members 4 into, along, and out of the guided support paths of the mobile support unit 3. The shelf means includes a plurality of hydraulic cylinder and piston assemblies such as, for example, the hydraulic cylinder and piston assembly 102 associated with the flooring 104 and each hydraulic cylinder and piston assembly includes a linear guide wall fixed to the free end of its piston for groupwise engagement of a plurality of tube support members supported on the platform of the onload platform means 100, such as, for example, the linear guide bar 101 mounted on the free end of the piston of the hydraulic cylinder and piston assembly 102.

The onload components of the onsite transfer means operate as follows to load the tube support members 4 onto the mobile support unit 3 in the embodiment illustrated in FIGS. 4 and 4*a*. Each of the tube support members 4 supporting a full yarn package 5 thereon is delivered by the transport device of the textile spinning 1 to the exit location at which the platform of the onload platform means 100 is disposed at generally the same vertical level as the exit sliding support component 77" of the textile spinning machine 1 for transfer of the tube support members to the platform. Each tube support member 4 transferred in this manner is further advanced along the smooth sliding surface of the platform by abutting engagement by the next following tube support member 4 exiting the transport device of the textile spinning machine 1 until, eventually, a full complement of the tube support members 4 are loaded on the platform. The platform is preferably provided with a stop member 100' at its end remote from the exit location to prevent the travel of the tube support members 4 therepast.

In correspondence with the loading of a full complement of the tube support members 4 on the platform on the onload platform means 100, the platform is raised to generally the same vertical level as the respective one of the floorings to which the tube support members are to be transferred and the hydraulic cylinder and piston assembly associated with the flooring is operated to transfer the tube support members. For example, if the tube support members on the platform are to be delivered to the flooring 104, the platform is raised to generally the same vertical level as the flooring 104 and the hydraulic cylinder and piston assembly 102 is operated to extend its linear guide bar 10 laterally across the platform to thereby push the tube support members into the guided support paths of the flooring 104.

The offload transverse support component 107 includes a portion 106 adjacent the outlet ends of the guided support paths which is relative slightly below the vertical level of the guided support paths. Additionally, the opposite lengthwise edge of the offload transverse support component 107 is configured with a slight upward taper to minimize the risk that the tube support members 4 on the offload transverse support component 107 will travel laterally beyond the support component. The lowered portion 106 of the offload transverse support component 107 acts to incline the tube support members slightly downwardly against the ends of the guided support surfaces to thereby reliably guide the tube support members 4 as they are moved transversely along the offload transverse support component 107.

The onsite transfer means also includes transverse row movement means associated with each of the floorings of the mobile support unit 3 for transversely moving a row of the tube support members supported on the respective offload transverse support component of the flooring onto the offload platform means 113. As seen in FIG. 4, for example, the transverse row movement means associated with the flooring 104 includes an endless belt 108 trained around a guide roller 108" and a drive roller 108', which is operatively connected to a drive roller 109 for driving operation of the endless belt 108. The guide roller 108" and the drive 108' are each mounted by a bracket 114 to a frame 110. The endless belt 108 has a pair of pusher bars 111 mounted thereto, and extending outwardly therefrom, the pusher bars 111 being spaced equi-distant from one another in both directions of the endless belt. Each pusher bar 111 is adapted to engage the endmost one of the tube support members 104 supported on the offload transverse support component to thereby effect advancing movement of the plurality of the tube support members along the offload transverse support component onto the offload platform means. As one of the pusher bars 111 completes its travel in offloading a plurality of tube support members, the other pusher bar 111 moves into a ready position for engaging the next plurality of the tube support members to be loaded onto the offload transverse support component 107.

The offload platform means 113 includes an offload platform having a smooth sliding surface and a pair of carrier brackets 121 each mounted to the platform. A pair of vertical rails 124 are provided for sliding movement of the pair of carrier brackets 121 therealong to guide the offload platform during vertical movement thereof. A pair of lift cables 115 each have one end fixedly mounted to a respective one of the carrier brackets 121 and its other end secured to a winding roller for winding and unwinding of the lift cable. The winding rollers are commonly mounted on a rotation shaft 117 which is operatively connected to a drive motor 120 for winding and unwinding rotation of the winding rollers. The rotation shaft 117 is rotatably mounted on a frame 118.

The offload platform is vertically movable to receipt positions adjacent the respective offload transverse support components of the floorings of the mobile support unit 3 for receiving the tube support members 4 transferred thereto by the transverse movement means associated with the respective flooring. The offload platform includes an end stop member 122 which prevents movement of the tube support members therepast at the end of the offload platform remote from the mobile support unit 3.

The onsite transfer means also includes offload ejector means in the form of a hydraulic and cylinder and piston assembly for groupwise transfer of a plurality of the tube support members 4 on the offload platform onto an entry path device 123. For example, the onsite transfer means includes a hydraulic cylinder and piston assembly 119 having a linear guide bar 116 mounted to the free end of its piston.

The entry path device 123 includes a receipt portion extending generally parallel to the offload platform for receiving the tube support members transferred from the offload platform and an intermittent feed means preferably in the form of a Geneva mechanism 126 for individually guiding the tube support members 4 through an arcuate portion 125. The Geneva mechanism 126 is controlled to rotate at a rate of rotation in correspondence with the travel of the endless belts 72'' of the textile spinning machine 1 such that a tube support member 4 is delivered to the endless belt 72' in correspondence with the arrival of a carrier member 73'' at the tube support receiving location.

The transport system illustrated in the embodiment in FIG. 4 and 4a is provided with a control unit 112 for controlling the operations of the various moving components and, in this regard, each of the hydraulic cylinder and piston assemblies such as, for example, the hydraulic cylinder and piston assembly 102 of the shelf movement means is operatively connected to the control unit 112 by a lead such as, for example, a lead 102'. Likewise, the drive motor 109 for driving the endless belt 108 is connected to the control unit 112 by lead 109'. The hydraulic cylinder and piston assembly 119 is connected by a lead 119' to the control unit 112. The drive motor 120 is connected by a lead 120' to the control unit 112.

The entry path device 123 advantageously provides the flexibility to the transport system to transport the tube support members 4 to the respective textile machine in accordance with the so-called "first in-first out" supply principle in which the first tube support member 4 delivered to the mobile support unit 3 at the other textile machine is the first tube support member to be transferred to the textile spinning machine 1 with the other tube support members being delivered in correspondence with their order of loading onto the mobile support unit 3.

Figure 5:
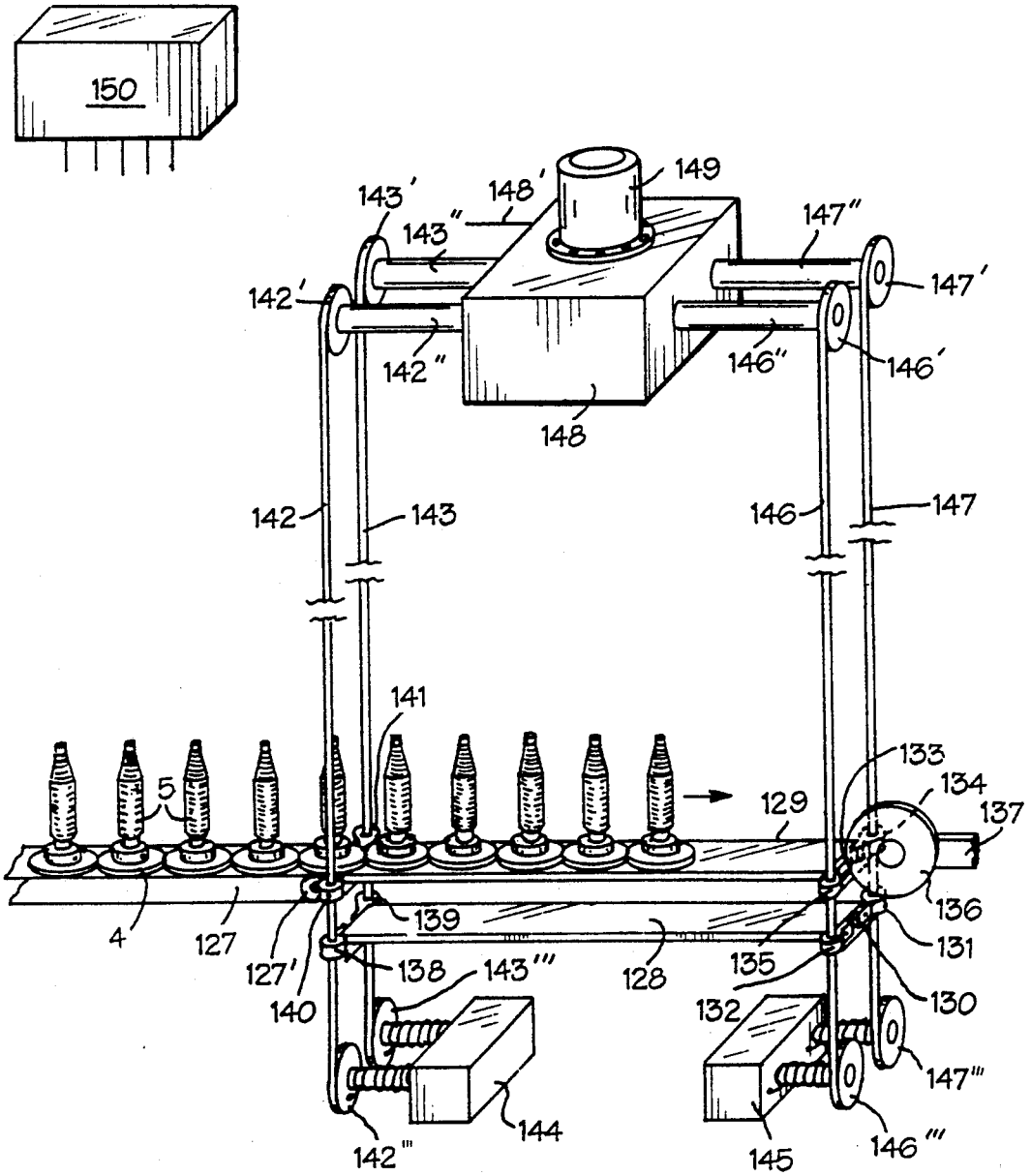
FIG. 5 is a perspective view of one variation of the vertical platform means of the transport system shown in FIGS. 1 and 2.
Figure 6:
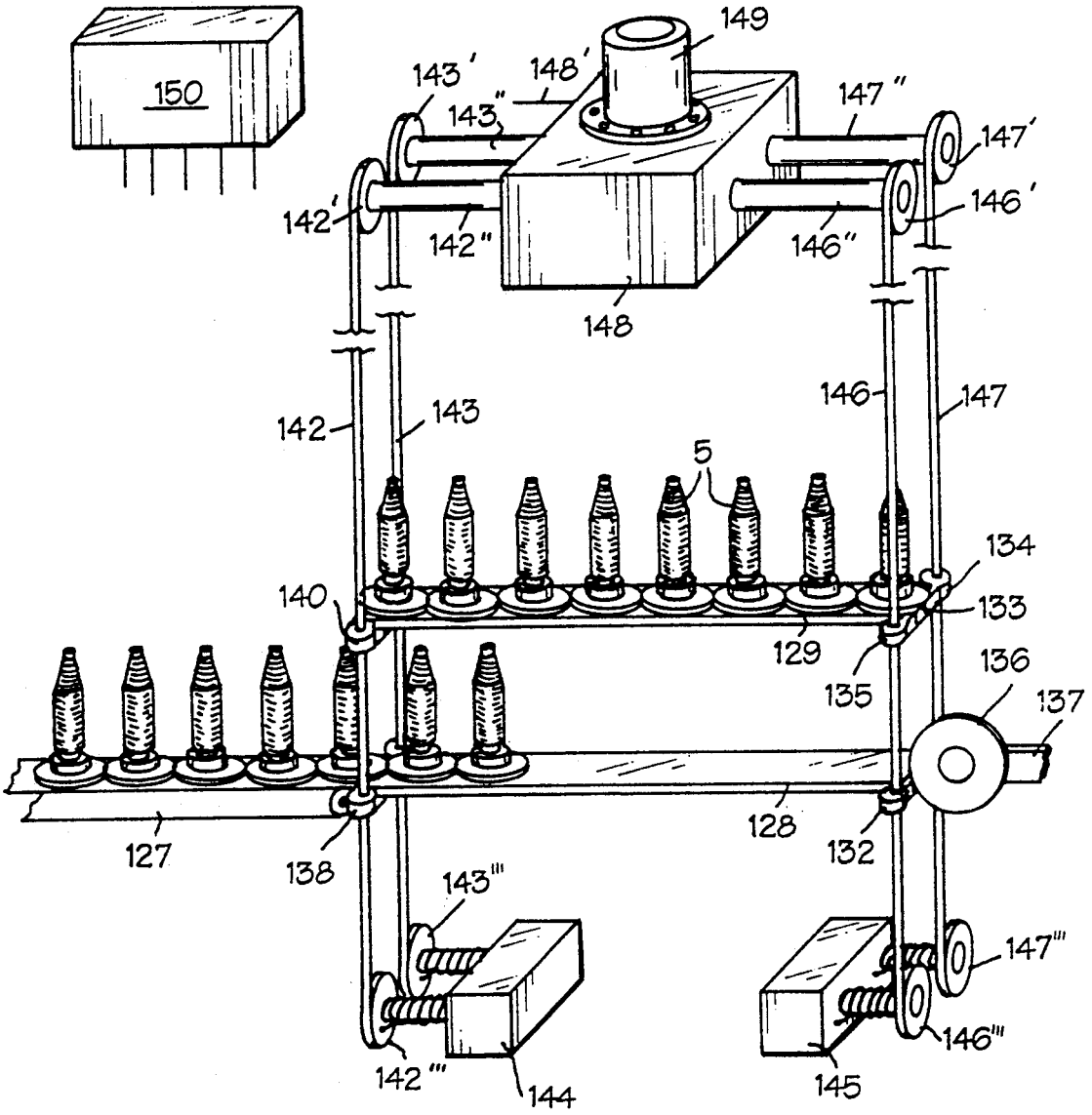
FIG. 6 is a perspective view of the variation of the vertical platform means of the transport system shown in FIG. 5.

In FIGS. 5 and 6, a variation of a platform means of the transport system is illustrated for use in loading or unloading tube support members from the mobile support unit 3. The variation of the platform means illustrated in FIGS. 5 and 6 is operable to transfer the tube support members 4 from an exit transport component of the textile spinning machine which delivers the tube support members 4 supporting full yarn packages 5 thereon to the platform means. The platform means includes a lower platform 128 having a cable securement bracket mounted to each respective end thereof and an upper platform 129 having a cable securement bracket mounted to each respective end thereof. A plurality of lift cables 142, 143, 146, and 147 each extend from a winding roller 142', 143', 146', and 147', respectively, to a tensioning roller 142''', 143''', 146''', and 147''', respectively. Each of the winding rollers 142', 143', 146', and 147' is mounted to a rotation shaft 142'', 143'', 146'', and 147'', respectively, and these rotation shafts are rotatably supported in a rotation housing 148. A rotation drive motor 149 is mounted to the rotation housing 148 and is operatively connected via a lead 148' to a control unit 150.

Each of the tensioning rollers 142''', 143''', is rotatably mounted to a rotation support housing 144 and each of the tensioning rollers 146''',147'''is rotatably mounted to a rotation housing 145. The tensioning rollers each have a tensioning spring wound about its rotation axis for biasing the tensioning roller to rotate in a predetermined direction.

One of the cable securement brackets of the lower platform 128 includes a throughbore 138 which receives the cable 142 therethrough for free movement of the cable relative thereto and a securement bore 139 which receives the cable 143 therethrough. A conventional clamp means (not shown) secures the cable securement bracket to the cable 143 for movement of the lower platform 128 in correspondence with movement of the cable 143. The other cable securement bracket of the lower platform 12 includes a throughbore 131 through which the cable 147 extends for free travel of the cable relative to the lower platform 128 and a securement bore 132 at the diagonally opposite corner of the lower platform 128 as the securement bore 139, for clamping securement of the cable securement bracket to the cable 146.

One of the cable securement brackets of the upper platform 129 has a throughbore 141 through which the cable 143 extends for free movement of the cable relative to the upper platform and a clamp bore 140 through which the cable 142 extends for clamping securement to the upper platform 129 for movement of the upper platform in correspondence with the movement of the lift cable 142. The other cable securement bracket of the upper platform 129 includes a throughbore 135 through which the lift cable 146 extends for free movement of the cable relative to the upper platform 129 and a securement bore 134 through which the lift cable 147 extends for securement of the lift cable 147 to the upper platform. The upper platform 129 is therefore secured to two diagonally opposed lift cables 142,147 for vertical movement thereby with the other pair of diagonally opposed lift cables 143,146 acting to guide the platform during its vertical movement. The lower platform 128 is secured to the diagonally opposed pair of lift cables 143,146 for vertical movement of the platform thereby While the platform is guided by the other pair of diagonally opposed lift cables 142,147.

In operation, the upper platform 129 is positioned at the same vertical level as the exit transport component 127 for receiving a plurality of the tube support members 4 advanced onto the upper platform. A roller 136 rotatably mounted on a bracket 137 is provided for engaging the end of each platform 128,129 remote from the exit transport component 127 to maintain the respective platform in close engagement with the exit transport component 127. When a full complement of the tube support members 4 have been received on the upper platform 129, the control unit 150 controls the rotation drive motor 149 to rotate the winding rollers 142',147' in the winding direction to effect upward vertical movement of the upper platform 129. As the upper platform travels upwardly, the lift cables 143,146 move freely relative to the upper platform through the throughbores 141,135, respectively, and act to guide the upper platform as it travels. Once the upper platform 129 has traveled upwardly sufficiently to permit the lower platform 128 to receive the tube support members 4 thereon, such as illustrated in FIG. 6, the control unit 150 controls the rotation drive motor 149 to effect winding rotation of winding rollers 143',146' to thereby raise the lower platform to the same vertical level as the exit transport component 127. The upward vertical movement of the upper platform 129 continues without interruption until the upper platform is at the same vertical level as the respective intermediate holding assembly for transverse support component to which the plurality of the tube support members on the upper platform will be transferred.

The tensioning rollers 142''', 143''', 146''', and 147''' maintain the respective cables secured thereto under continuous tension during the winding and unwinding of the cables. The upper platform 129 can be controlled to travel to the upper ones of the floorings of the mobile support unit 3 while the lower platform 128 can be controlled to travel to the lower ones of the floorings.

The lower platform 128 is provided with a stop member 130 at its remote end for fanning the movement therepast of the tube support members 4. The upper platform 129 includes a stop member 133 at its remote end for preventing the movement therepast of the tube support members 4.

Figure 7:
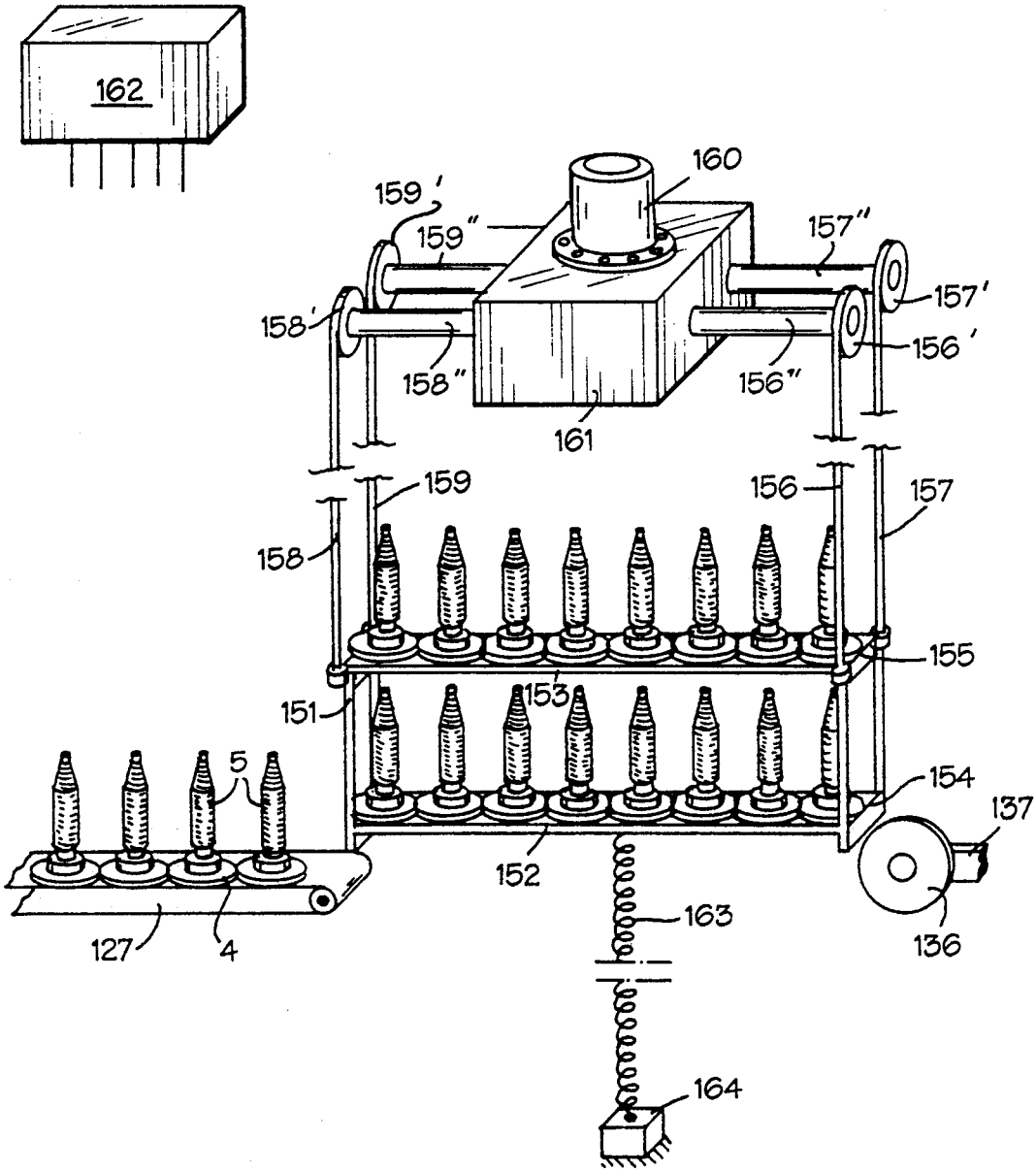
FIG. 7 is a perspective view of a further variation of the vertical platform means of the transport system shown in FIGS. 1 and 2.

In FIG. 7, another variation of the platform means of the transport system of the present invention is illustrated. A platform frame 151 supports and upper platform 153 and a lower platform 152 in fixed relation to one another. Each platform 152,153 includes a remote end stop member 154,155, respectively, for preventing the travel of the tube support members 4 therepast. One end of a spring 163 is fixedly mounted to the underside of the lower platform 152 at a central portion thereof and the other end of the spring is fixedly mounted to an anchor block 164. A plurality of lift cables 156–159 each have a free end fixedly mounted to a respective corner of the upper platform 153 and the other end of the lift cables 157–159 are mounted to a winding roller 157'–159', respectively. The winding rollers 157'–159' are each fixedly mounted to a rotation shaft 157''–159'', respectively, and the rotation shafts are rotatably mounted in a rotation housing 161. A rotation drive motor 160 is mounted to the rotation housing 161 and is operatively connected a control unit 162.

In operation, the rotation drive motor 160 is controlled to synchronously rotate all of the winding rollers 156'–159' in the same winding or unwinding direction to effect raising or lowering of the frame 151. The spring 163 continuously applies a downward biasing force to the lift cables 157–159 through the frame 151 to maintain the lift cables under tension. The vertical movement of the frame 151 is controlled to selectively position the lower platform 152 and the upper platform 153, individually, at the same vertical level of the exit transport component 127 for loading the respective platform with a complement of the tube support members 4. The pair of platforms 152,153, once both are loaded, are then simultaneously raised to respective positions at an adjacent pair of the floorings of the mobile support unit for transfer of the tube support members 4 from the platforms to the mobile support unit.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A mobile transport system for the transport of independently movable tube support members to and from a textile machine, the tube support members supporting tubes of the type on which yarn packages are built or unwound, the mobile transport system comprising:

a mobile support unit for temporarily supporting tube support members thereon, the mobile support unit being movable to the textile machine for the transfer thereat of tube support members between the mobile support unit and the textile machine and including means for supporting a plurality of tube support members in a transfer row and means for supporting tube support members in a plurality of supply rows extending transversely to the transfer row, the transfer row supporting means being operable to support tube support members for movement in a direction transverse to the supply rows for transfer of the tube support members between the mobile support unit and the textile machine such that the tube support members in the transfer row can be moved transversely relative to the supply rows during transfer and the supply row supporting means including means for maintaining the tube support members in a serial linear arrangement in each supply row separate from the tube support members in the other supply rows while permitting individual movement of the tube support members in the respective supply row in a direction parallel to the serial linear arrangement of the tube support members, the supply rows being open at the same respective ends thereof to communicate with the transfer row for movement of tube support members between the supply rows and the transfer row on the mobile support unit and the serial linear arrangement maintaining means for the supply row supporting means extending no further than the open ends of the supply rows at the transfer row whereby tube support members can be moved along the transfer row supporting means transversely to the supply rows free of interference with the serial linear arrangement maintaining means and independent of any movement of tube support members supported in the supply rows; and means for transferring tube support members in a direction transverse to the supply rows during feeding thereof between the textile machine and the mobile support unit.

2. A mobile transport system according to claim 1 wherein the mobile support unit includes a second means for supporting tube support members in a second transfer row during transfer of the tube support members between the mobile support unit and the textile machine and a second means for guiding tube support members in a plurality of supply rows transverse to the second transfer row, the supply row guiding means and the second supply row guiding means being at least partially overlapping.

3. A mobile transport system according to claim 1 and further comprising means for moving tube support members between the transfer row supporting means and the supply row guiding means.

4. A mobile transport system according to claim 3 wherein the textile machine is at a different vertical level than the transfer row supporting means and the means for transferring tube support members between the textile machine and the transfer row supporting means includes vertical movement means for vertically moving a plurality of tube support members for transfer between the textile machine and the transfer row supporting means.

5. A mobile transport system according to claim 4 wherein the vertical movement means includes an upper platform for supporting a plurality of tube support members, a lower platform for supporting a plurality of tube support members, a platform frame for mounting the upper and lower platforms in fixed, spaced relation to one another with the platforms being operable to support separate pluralities of tube support members at the same time, and drive means for raising and lowering the platform frame to selectively position the upper and lower platforms at locations for transfer of tube support members between the respective platform and a selected one of the textile machine and the transfer row supporting means.

6. A mobile transport system according to claim 4 wherein the vertical movement means includes an upper platform for supporting a plurality of tube support members thereon, a lower platform for supporting a plurality of tube support members thereon, and vertical guide means for guiding the upper and lower platforms in generally superposed relation, and drive means for independently raising and lowering each platform.

7. A mobile transport system according to claim 3 wherein the means for transferring tube support members between the textile machine and the transfer row supporting means includes an intermediate assembly for supporting a plurality of tube support members transferred thereto from a selected one of the textile machine and the transfer row supporting means for subsequent transfer of the tube support members to the other of the textile machine and the transfer row supporting means, intermediate loading means for transferring tube support members between the textile machine and the intermediate assembly, and means for moving tube support members between the intermediate assembly and the transfer row supporting means.

8. A mobile transport system according to claim 7 wherein the textile machine and the transfer row supporting means are at different vertical levels and the intermediate holding assembly is operable to support tube support members generally at the level of the transfer row supporting means, and the means for transferring tube support members between the textile machine and the transfer supporting means includes means for vertically moving tube support members between the intermediate assembly and the textile machine.

9. A mobile transport system according to claim 7 wherein the mobile support unit includes a second means for supporting a plurality of tube support members in a second transfer row and second means for guiding tube support members in a plurality of second supply rows transverse to the second transfer row, the first-mentioned supply row guiding means and the second supply row guiding means being at least partially superjacent and further comprising a second intermediate assembly, positioned generally at the level of the second transfer row supporting means, for supporting tube support members thereon for transfer between the second intermediate assembly and the second transfer row supporting means, and the vertical moving therefor means is operable to vertically move a plurality of tube support members between the textile machine and a position adjacent the second transfer row supporting means for transfer of tube support members between the vertical moving therefor means and the second transfer row supporting means, and the intermediate loading means is operable to transfer tube support members between the vertical moving therefor means and the first and second intermediate assemblies and means for moving tube support members in the second transfer row from the second transfer row supporting means to the second supply rows.

10. A mobile transport system according to claim 1 wherein there are two said transfer row supporting means at opposite ends of the supply rows, one of the transfer row supporting means being an offload transverse support means operable to support a plurality of tube support members transferred thereto from the supply row guiding means for subsequent unloading of the tube support members to the textile machine and the other transfer row supporting means being an onload transverse support means for receiving tube support members discharged from the textile machine for transfer thereof to the supply rows.

11. A mobile transport system according to claim 10 wherein each of the supply rows has a pair of opposed ends and the offload transverse support means includes a lateral edge extending transversely to the supply rows adjacent the same respective opposite ends of the supply rows and extending downwardly therefrom and an opposed lateral edge, the tube support members supported on the offload transverse support component being supported between the lateral edges whereby the lateral edge guide the tube support members during unloading.

12. A mobile transport system according to claim 1 wherein the means for transferring tube support members between the textile machine and the transfer row supporting means includes an intermediate assembly for supporting a plurality of tube support members transferred thereto from a selected one of the textile machine and the transfer row supporting means and intermediate transfer means for transferring a plurality of tube support members supported on the intermediate assembly to the other of the textile machine and the transfer row supporting means.

13. A mobile transport system according to claim 1 wherein each tube support member includes a generally cylindrical base portion and an upright portion co-axially mounted on the base portion, and the supply row guiding means includes a plurality of guide members arranged in parallel, spaced relation to one another and each having a base portion and a laterally projecting portion mounted on its base portion, the laterally projecting portion of each guide member extending over the base portion of a tube support member in the therefor supply row and the laterally projecting portions of adjacent pairs of the guide members forming a passage therebetween for the passage therethrough of the upright portions of the tube support members to effect guiding of the tube support members in the supply rows.

14. A mobile transport system according to claim 11 wherein each tube support member includes a generally cylindrical base portion having a generally cylindrical upper component and a tapering lower component tapering inwardly from the upper cylindrical component toward the bottom of the tube support member, and the supply row guiding means includes a plurality of guide members arranged in spaced parallel relation to one another to form the supply rows therebetween, and each guide member having a cross-sectional shape compatible with open spaces formed by the tapering lower component of a pair of laterally adjacent tube support members in abutting engagement with one another along their upper cylindrical components.

15. A mobile transport system according to claim 1 and characterized further by means for effecting advancement of tube support members along the supply rows, the transfer row supporting means being operable as an offload transverse support means operable to support a plurality of tube support members transferred thereto from the supply row guiding means for unloading of tube support members to the textile machine and the advancement effecting means being operable to advance tube support members beyond the supply rows into the transfer row for subsequent transfer of the tube support members to the textile machine.

16. A mobile transport system according to claim 1 and characterized further by means for effecting advancement of tube support members along the supply rows, the transfer row supporting means being an onload transverse support means operable to support a plurality of tube support members transferred thereto from the textile machine for subsequent loading of the tube support members into the supply rows and the advancement effecting means being operable to transfer a plurality of tube support members supported in the transfer row into the supply rows.

17. A mobile transport system for the transport of independently movable tube support members to and from a textile machine, the tube support members supporting tubes of the type on which yarn packages are built or unwound, the mobile transport system comprising:

a mobile support unit for temporarily supporting a plurality of tube support members thereon, the mobile support unit being movable to the textile machine for transferring tube support members between the textile machine and the mobile support unit, the mobile support unit including:

first onload transfer row means for supporting a plurality of tube support members in a first onload transfer row, first means for guiding tube support members in a plurality of first supply rows transverse to the first onload transfer row, first offload transfer support means for supporting a plurality of tube support members in a first offload transfer row, the first onload transfer row support means and the first offload transfer row support means each being adjacent a respective opposite end of the first supply row guiding means, second onload transfer row support means for supporting a plurality of tube support members in a second onload transfer row, second offload transfer row support means for supporting a plurality of tube support members in a second offload transfer row, second means for guiding tube support members in a plurality of second supply rows transverse to the second onload transfer row, the second supply row guiding means having opposite ends and the second onload transfer row support means and the second offload transfer row support means each being adjacent a respective opposite end of the second supply row guiding mean; and means for transferring tube support members from the textile machine to each of the first and second onload transfer row support means and for transferring tube support members from each of the first and second offload transfer row support means to the textile machine.

18. A mobile transport system according to claim 17 wherein the first onload transfer row, first supply rows, and first offload transfer row are disposed in a generally horizontal first plane, and the second onload transfer row, second supply rows, and second offload transfer rows are disposed in a generally horizontal second plane.

19. A mobile transport system according to claim 17 wherein the means for transferring tube support members between the textile machine and the first and second onload transfer row support means includes a first intermediate assembly, positioned generally at the level of the first onload transfer row for supporting a plurality of tube support members for transfer to the first onload transfer row, a second intermediate assembly, positioned generally at the level of the second onload transfer row for supporting a plurality of tube support members for transfer thereof to the second onload transfer row support, and onload vertical movement means for vertically moving a plurality of tube support members from the textile machine to a position adjacent at least one of the first and second onload intermediate assemblies for transfer of tube support members to the respective onload intermediate assembly.

20. A mobile transport system according to claim 19 wherein the means for transferring tube support members from the first and second offload transfer row support means to the textile machine includes a first offload intermediate assembly, positioned generally at the level of the first offload transfer row for supporting a plurality of tube support members transferred thereto from the first offload transfer row, a second intermediate assembly, positioned generally at the level of the second offload transfer row for supporting a plurality of tube support members transferred thereto from the second offload transfer row, and offload vertical movement means for vertically moving a plurality of tube support members transferred thereonto from at least one of the first and second offload intermediate assemblies to the textile machine.

21. A mobile transport system according to claim 20 and further comprising first onload ejector means for groupwise transfer of a plurality of tube support members supported on the onload vertical movement means to the first onload intermediate assembly and second onload ejector means for groupwise transfer of a plurality of tube support members supported on the onload vertical movement means onto the second onload intermediate assembly.

22. A mobile transport system according to claim 21 wherein each guide member has an overlapping portion which overlaps a portion of each tube support member being guided by the guide member and the overlapping portion of each of the guide members has an end portion adjacent the transfer row supporting means which includes a guide profile for guiding tube support members into the spacing between each adjacent pair of the overlapping portions of adjacent guide members.

* * * * *